United States Patent [19]

Morelli

[11] Patent Number: 4,688,876

[45] Date of Patent: Aug. 25, 1987

[54] CONNECTOR FOR COAXIAL CABLE

[75] Inventor: John A. Morelli, Merrimack, N.H.

[73] Assignee: Automatic Connector, Inc., Commack, N.Y.

[21] Appl. No.: 873,251

[22] Filed: Jun. 3, 1986

Related U.S. Application Data

[63] Continuation of Ser. No. 226,128, Jan. 19, 1981, abandoned.

[51] Int. Cl.[4] ..... H01R 17/04

[52] U.S. Cl. ..... 439/578; 439/595

[58] Field of Search ..... 339/177 R, 177 E, 217 S, 339/275 R, 275 T

[56] References Cited

U.S. PATENT DOCUMENTS

| | | | |
|---|---|---|---|
| 3,336,563 | 8/1967 | Hyslop | 339/177 R X |
| 3,550,064 | 12/1970 | Caller et al. | 339/177 R |
| 3,678,444 | 7/1972 | Stevens et al. | 339/177 R X |
| 3,845,453 | 10/1974 | Hemmer | 339/177 R X |
| 3,936,125 | 2/1976 | Hutter | 339/177 E X |
| 4,125,308 | 11/1978 | Schilling | 339/177 R X |

*Primary Examiner*—Timothy V. Eley

*Attorney, Agent, or Firm*—Peter L. Berger

[57] ABSTRACT

A connector for a coaxial cable has a central conductor adapted to be connected to the central conductor of a coaxial connector. A first insulator is fixedly held on a central conductor and has an outwardly extending ridge. A pair of other insulators are held in abutting relationship in an outer conductor assembly, the other insulators defining a recess receiving the ridge of the first insulator. The assembly of the central conductor at first insulator may be axially snapped into the assembly of the other insulators and outer conductor.

5 Claims, 10 Drawing Figures

CONNECTOR FOR COAXIAL CABLE

This application is a continuation of application Ser. No. 226,128, filed Jan. 19, 1981 abandoned.

BACKGROUND OF THE INVENTION

This invention is directed to connectors for coaxial cables, and it is more particularly directed to an improved coaxial cable connector especially suitable for small diameter cables. It will of course be apparent that the invention is not limited to this application.

In one type of coaxial cable connector, a tapered outer conductor element has an internal insulator holding the central conductor. This assembly is adapted to receive a coaxial cable, with the central conductor of the cable enter in the central conductor of the connector, to be soldered therein. The outer conductor of the assembly, after the coaxial cable is connected thereto, is adapted to be fit in an outer shell, and to be held in the outer shell by means of a threaded ferrule inserted in the rear of the outer shell.

This arrangement has a number of disadvantages. First, the assembly requires the manipulation of three separate elements, i.e., the outer shell, the ferrule and the combined inner conductor and tapered outer element. The connector further requires, following the assembly of the coaxial cable on the inner assembly, the insertion of the inner assembly in the outer shell and the threading of the ferrule in place.

The present invention is directed to the provision of a coaxial cable connector that overcomes these disadvantages of the the above-described known connector.

In a further known coaxial cable connector, the inner conductor of the connector is provided with an annular recess about a central portion thereof, and the insulator surrounding the central conductor has an inwardly directed annular ridge. In the assembly of the structure, the connector is urged through the hole in the insulator, until the ridge in the insulator snaps into position in the recess of the connector.

While this arrangement, as disclosed in U.S. Pat. No. 3,439,294, Flanagan, is suitable for larger sizes of coaxial cables, it has been found that for miniature connectors, wherein the diameter of the inner conductor may be of the order of 0.025 inches, the resultant deformation of the resilient end of the inner conductor is not permissible, and it is difficult to insert a central conductor of such small diameter in an insulator held by this technique.

SUMMARY OF THE INVENTION

In accordance with the present invention, the above disadvantages of the known coaxial cable connectors is overcome by the provision of a connector having a central connector element with a first insulator fixedly held therein. The first insulator has an outwardly extending annular ridge.

The connector assembly further includes an outer conductive assembly including an outer shell having an internally extending ridge, and a ferrule held in the outer shell and also having an internally extending ridge. A pair of axially abutting second and third insulators are held between the ridges of the outer shell and ferrule, to form a preassembly.

At least one of the insulators of the outer assembly has an annular internal recess, of a shape to receive the annular ridge of the first insulator. The ridge of this insulator and the recess of the outer insulator are proportioned to enable the first insulator, carrying of the central conductor, to be snapped with its ridge engaging the recess of the outer insulators.

The resultant connector consequently has only two sub-assemblies, and the sub-assemblies may be connected together by a simple axial movement snapping them together. In addition, deformation of the central conductor of the connector assembly is not necessarily in order to assemble a connector.

BRIEF FIGURE DESCRIPTION

In order that the invention will be clearly understood, it will now be disclosed in greater detail with reference to the accompanying drawings, in which.

DETAILED DISCLOSURE OF THE INVENTION

Figure 1:
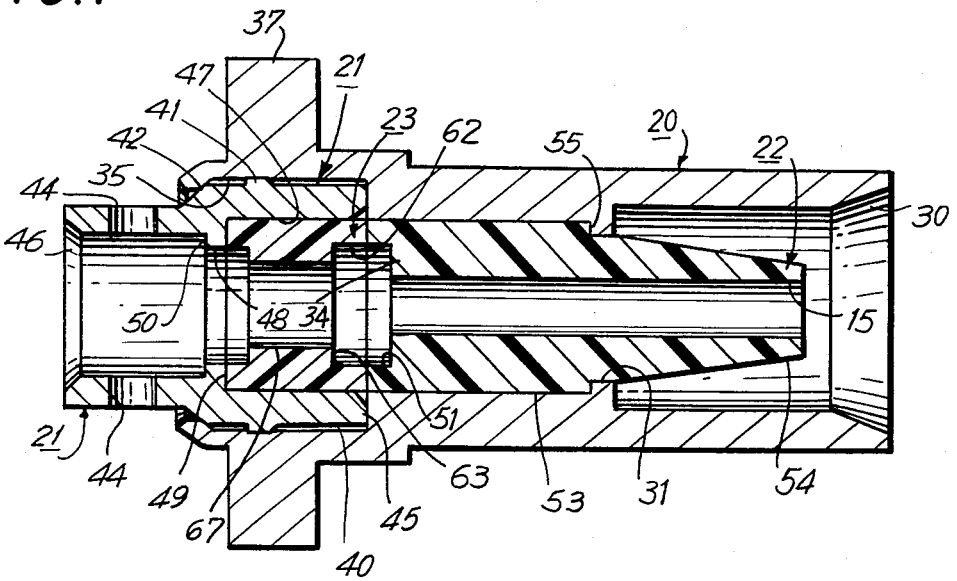
FIG. 1 is a cross-sectional view of the outer assembly of the coaxial cable connector of the invention.
Figure 2:
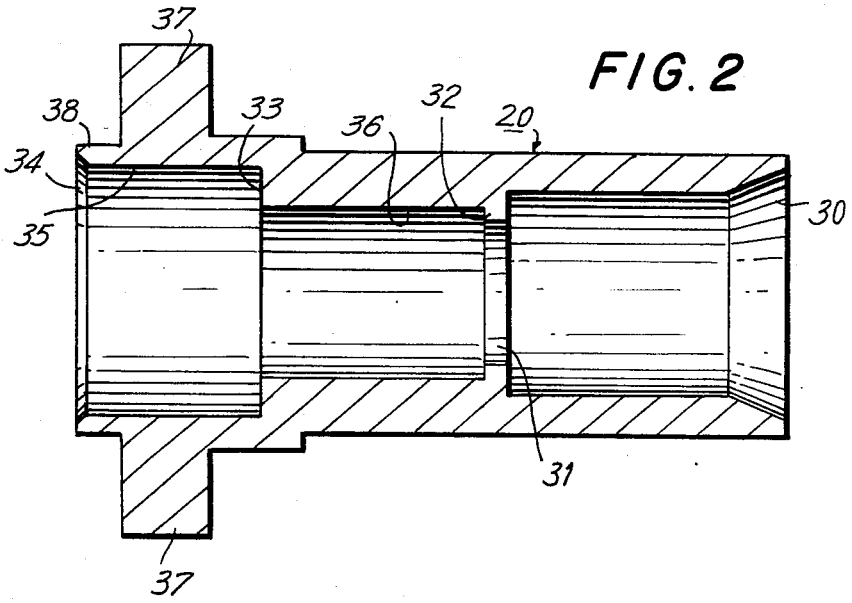
FIG. 2 is an enlarged cross-sectional view of the body of the assembly of FIG. 1.

FIG. 1 is a cross-sectional view of a first pre-assembled group of elements of the connector of the invention. This assembly is comprised of a tubular conductive outer body 20, and a conductive ferrule 21 inserted in the rear end of the body 20. The assembly further includes an elongated front insulator 22 in the forward portion of the body 20, and annular rear insulator 23 within the ferrule and abutting the rear end of the insulator 22. As more clearly shown in FIG. 2, the body 20 has an open end 30 for receiving another connector, and the outer portion of the body in this region may be threaded or bayoneted, if desired, for holding this connector and another together. An annular internal ridge 31 is provided a short distance within the open end 30, for example, about 0.185 inches, the tubular body at this portion having about the same diameter. The ridge 31 thereby provides an annular shoulder 32 facing rearwardly out of the body. The inside of the body has a further shoulder 33 spaced, for example, about 0.125 inches from the rear opening 34 thereof. The annular walls 35 between the shoulder 33 and the rear end 34 have a slightly greater diameter, for example, about 0.16 inches, than the annular portion 36 between the shoulders 32 and 33, the latter portion having a diameter of, for example, about 0.110 inches. External flanges or an external annular ridge 37 may be provided, extending outwardly adjacent the rear end of the tubular body, for mounting purposes, the form of this projection not being material to the invention. The ends 30 and 34 of the body may be inwardly tapered, as illustrated, to facilitate assembly of the connector with another connector, and to facilitate assembly of the connector itself. As an example, the overall length of the body 20 may be about 0.470 inches.

It will be further noted that the body 20 has an annular rearwardly extending portion 38 behind the ridge 37, this portion being sufficiently thin that it may be deformed, as will be discussed in later paragraphs.

Figure 3:
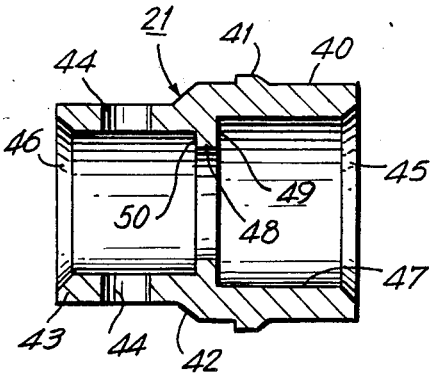
FIG. 3 is an enlarged cross-sectional view of the ferrule of the assembly of FIG. 1.

The ferrule 21 is more clearly illustrated is FIG. 3. This ferrule is generally tubular, and has a forward portion 40 with a diameter slightly less than the inside diameter of the portions 35 of the body. The length of the portion 40 is less than the length of the portion 35, minus the axial length of the deformable extension 38 of the body. An annular ridge 41 may be provided on the annular surface 40, the ridge 41 having a diameter slightly greater, for example, by about 0.002 inches, so that the forward portion of the ferrule may be forcefit into the portion 35 of the body. Immediately behind the portion 40, the ferrule 21 is tapered radially inwardly, as shown at reference numeral 42. The ferrule then has an annular rear portion 43 adjoining the tapered portion 32, the rear portion 43 having one or more transfers holes 44 extending through its walls. The front and rear openings 45 and 46 of the ferrule may be tapered, to simplify assembly.

The inner surface 47 of the front portion of the ferrule may have a diameter of about 0.110 inches, i.e., about the same of the portion 36 of the body. Immediately, behind the portion 47, in alignment with the rear end of the portion 40 of the ferrule, an annular inner ridge 48 is provided. The ridge 48 defines a forwardly directed shoulder 49, and a rearwardly directed shoulder 50. The inner diameter of the shoulder 48 is determined by the diameter of the internal insulation, i.e., between the central and outer conductors of the coaxial cable to be joined to the connector.

Figure 4:
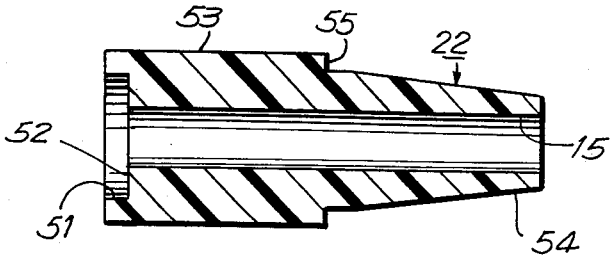
FIG. 4 is a enlarged cross-sectional view of the front insulator of the assembly of FIG. 1.

The front insulator 22 is more clearly illustrated in FIG. 4, wherein it is seen that the elongated insulator has a central hole 15 extending therethrough. The hole 15 has a diameter to fit the central pin of the connector, as will be described in more detail in the following paragraphs. An annular recess 51 is provided at the rear of the insulator 22, thereby defining a rearwardly directed shoulder 52. The rear portion 53 of the insulator has a constant diameter and is separated from the front tapered portion 54 by a forwardly extending shoulder 55. The diameter of the portion 53 of the insulator is slightly less than the diameter of the portion 36 of the body, so that, as illustrated in FIG. 1, the insulator 22 may be inserted in the body 20 from the rear, with the shoulder 55 of the insulator engaging the shoulder 32 of the body, thereby to inhibit further forward displacement of the insulator. The overall length of the insulator 22 may be about 0.316 inches, with the length of the rear portion 53 being about 0.175 inches. Thus, as shown in FIG. 1, the rear portion 53 of the insulator 22 has a length somewhat greater that the length of the portion 36 of the body.

Figure 5:
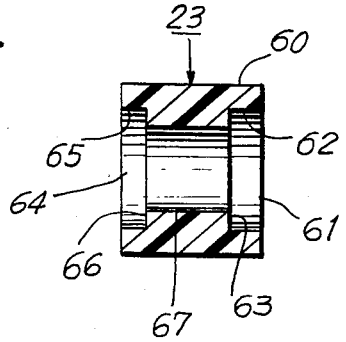
FIG. 5 is an enlarged cross-sectional view of the rear insulator of the assembly in FIG. 1.

The rear insulator 23 of FIG. 1 is more clearly shown in FIG. 5. This insulator has a constant diameter outer surface 60 substantially equal to the outer diameter of the portion 53 of the insulator 22. The insulator 23 has an overall length of, for example, about 0.63 inches. The internal diameter of the forward end 61 of the insulator 23 has an annular recess 62, defining a forwardly directed shoulder 63 which also is known as a counterbore 63. The rear end 64 of the insulator has an annular recess 65, thereby defining a rearwardly directed shoulder 66. The central portion 67 has an internal diameter of, for example, about 0.058 inches, the frônt recess 62 has a diameter of about 0.069 inches and the rear recess 65 has a diameter of about 0.072 inches. The axial links of the portions 62 and 67 may be equal to about 0.25 inches each.

As illustrated in FIG. 1, the insulator 23 abuts the rear end of the insulator 22, and the forward end 45 of the ferrule is inserted in the rear hollow portion 35 of the body 20. The deformable rim 38 of the body is then rolled over to engage the tapered surface 42 of the ferrule, thereby to hold the assembly together. It will be noted that the rear end 64 of the insulator engages the shoulder 49 of the ferrule, thereby to firmly hold the insulators 22 and 23 within the body 20 and ferrule 21 against both axial and radial movement.

The assembly illustrated in FIG. 1 thus comprises a first preassembled group of elements for the connector in accordance with the invention. Various dimensions have been mentioned, as examples only, in order to show the interrelationship between the portions of this preassembly and the sub-assembly illustrated in FIG. 6 of the drawing.

Figure 6:
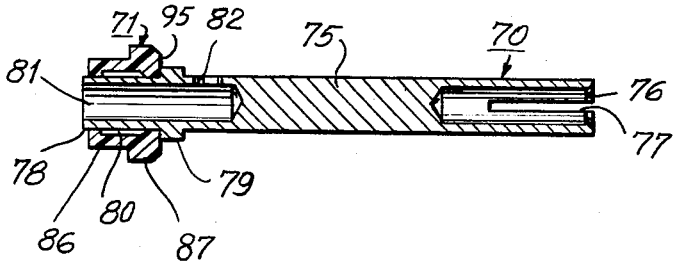
FIG. 6 is an partially cross-sectional view of the central assembly of the connector of the invention.
Figure 7:
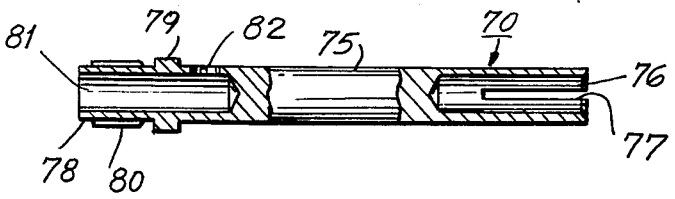
FIG. 7 is an partially cross-sectional view of the central conductor or pin of the assembly of FIG. 6.

Referring now to FIG. 6, the central assembly comprises a central pin or connector 70, and a captivating insulator 71 fits over the rear end of the connector 70. The connector 70, as more clearly illustrated in FIG. 7, is a conductive element having an overall length of about 0.374 inches. The front portion 75 of the connector 70 has a length of the 0.299 inches and a diameter of about 0.034 inches, so that it will fit snuggly in the central hole of the insulator 22 of FIG. 1. A central axially extending hole 76 extends a short distance, for example, 0.1 inches into the front portion 75, whereby the connector 70 serves as a female connector. Slots 77 may be provided in the side walls of the hole 76 in order to establish resilient contact with another connector. Its role of course will be apparent that this end of the connector may be modified to serve as a male connector without departing from scope of the invention.

The rear portion 78 of the connector has a diameter about the same as the front portion thereof, and an annular ridge 79 is provided between the front and rear portions of the connector. The rear portions may have a knurled outer surface, as shown at reference numeral 80.

The rear of the connector is provided with an central axial hole 81 for receiving a cable conductor, this hole extending slightly beyond the annular ridge 79. A solder hole 82 is provided in the wall of the front portion 75, extending into the hole 81 in order to permit soldering of a wire in the hole 81.

Figure 8:
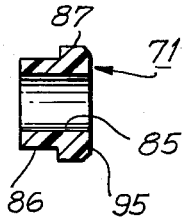
FIG. 8 is an enlarged cross-sectional view of the insulator of the assembly of FIG. 6.

The captivating insulator 71 is more clearly shown in FIG. 8. This insulator, of a length of about 0.047 inches, has a central axially extending hole 85 to receiver the knurled end portion 78 of the central connector, whereby the insulator 71 is firmly held on the connector. The rear outer surface 86 of the insulator 71 has a diameter of about 0.056 inches, i.e., only slightly less than the internal diameter of the insulator 23 of FIG. 1. The front outer surface or annualr shoulder 87 of the insulator 71 has a diameter of about 0.066 inches, i.e., slightly less than the diameter of the recess 62 of the insulator 23 of FIG. 1.

The insulators of the connector assemblies may be of, for example teflon; the body may be of steel; the ferrule may be of brass; and the central connector may be of beryllium copper. It is of course understood that these materials constitute examples only, and other suitable materials may be employed.

Figure 9:
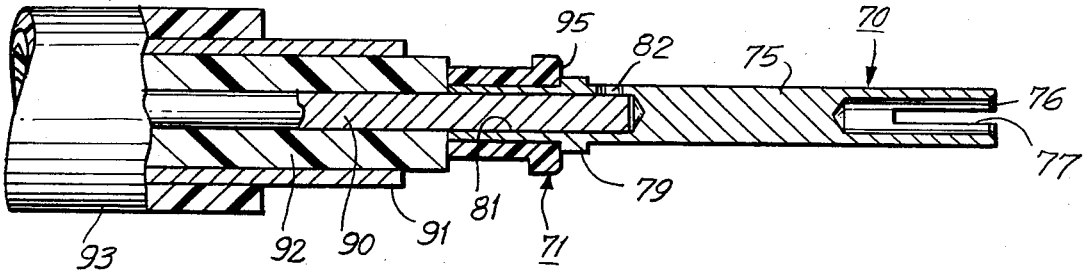
FIG. 9 is a cross-sectional view of the assembly of FIG. 6 connected to a coaxial cable.

The first step in use of the connector in accordance with the invention is illustrated in FIG. 9, wherein a coaxial cable is illustrated having a central conductor 90, an outer shield 91, an insulation layer 92 between the inner conductor and the shield, and, if desired, an outer insulating sheath 93.

As illustrated, the insulation 92 is cut back, to permit an exposed length of the central conductor 90 adequate to extend in the hole 81 beyond the solder hole 82. The shield 91 is cut back a slight distance further, i.e., a distance equal to the combined width of the recess 65 of the insulator 23 and the width of the inner ridge 48 of the ferrule. The outer insulator is cut back a further distance, so that it does not interfere with the rear opening of the ferrule.

After the central conductor 90 has been inserted in the hole 81, as shown in FIG. 9, with the front edge of the insulation 92 engaging the rear edge of the connector 70 and insulator 71, the central conductor 90 is soldered in place by way of the solder hole 82.

Figure 10:
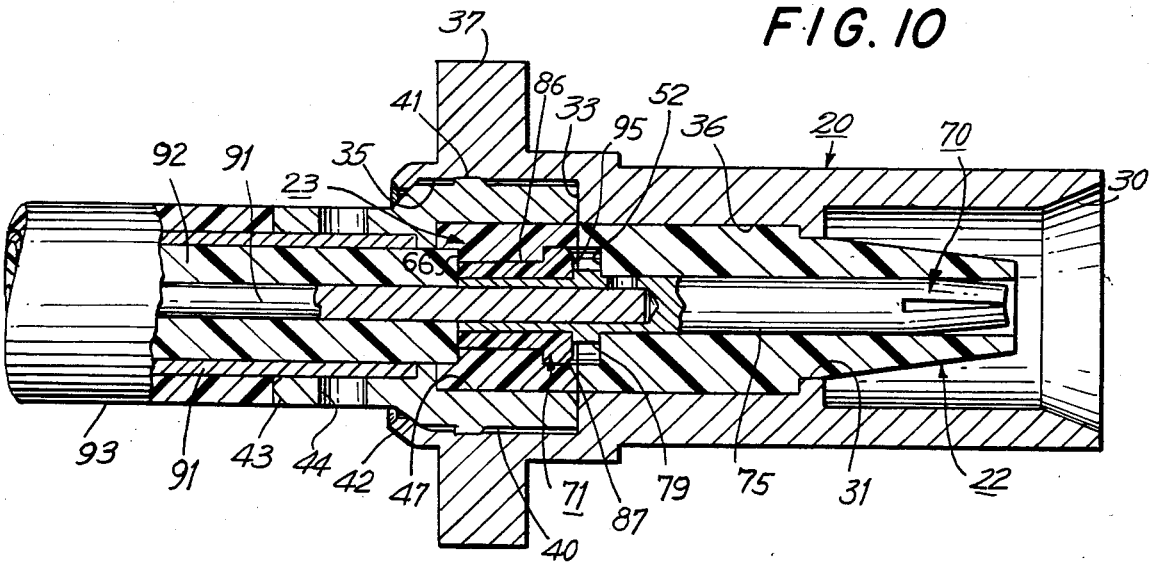
FIG. 10 is an cross-sectional view of a complete assembly connector in accordance with the invention, connected to a coaxial cable.

Following this, as illustrated in FIG. 10, the assembly of FIG. 9, with the cable attached thereto, is inserted in the rear of the assembly of FIG. 1. During this assembly, it will be noted that the contact or connector 70 first engages the central hole of the insulator 22, and the assembly of FIG. 6 is pushed further forward until the front edge 95 of the insulator 71 engages the shoulder 66 of the insulator 23. Recalling the relative dimensions of the central portion of the hole of the insulator 23 and the outer dimensions of the front portion 87 of the insulator 71, the insulator 71 has a diameter about 0.008 inches greater than the diameter of the hole in the insulator 23. Since the front edge 95 of the insulator 71 has a tapered outer rim, and the material of the insulator is somewhat compressible, the assembly of FIG. 6 may be forced into the assembly of FIG. 1, to result in the snapping of the front portion 87 of the insulator 71 into the front annular recess 62 of the insulator 23. This results in the firm holding of the assembly in FIG. 6 in the assembly of FIG. 1. The annular ridge 79 of the connector element 70 is received in the recess at the rear of the insulator 22, to abut the shoulder 52, thereby inhibiting forward movement of the connector. Since the front portion 87 of the insulator 71 has snapped into the forward recess of the insulator 23, it cannot readily be moved in the rear direction, so that, since the rear edge of the ridge 79 engages the front of the insulator 71, the connector also cannot readily be moved rearwardly in the final assembly.

Following this assembly, the shield may be soldered to the ferrule, by means of the solder hole 44 in the ferrule.

The connector of the invention is particularly adaptable for miniature connectors, as evidenced by the above noted examples of dimensions. Further, the connector is provided with two sub-assemblies, the sub-assemblies being readily interconnected merely by insertion of the central assembly in the outer assembly and snapping it in place. The elements of the connector, following such assembly cannot readily by separated.

While the invention has been disclosed and described with reference to a single embodiment, it will be apparent what variations and modifications may be made therein. It is therefore intended that the following claims shall cover each such variation and modification as falls within the true spirit and scope of the invention.

What is claimed is:

1. In a connector for a coaxial cable, including an elongated central conductive connector element, outer conductor means surrounding said central conductive connector element, and insulation means between said central conductive connector element and said outer conductive means, respective first ends of said central conductive connector element and outer conductive means being adapted to be joined to the central conductive connector element and outer shield of a coaxial cable, the other ends of said central conductive connector element and outer conductive means being adapted to be connected to a further connector, the improvement wherein said insulation means comprises a front insulator portion having a central aperture therethrough, a rear insulator fixedly held in said outer conductor means, and having a central aperture aligned with the central aperture of said front insulator portion, and a captivating insulator fixedly held on said conductive element, said conductive element and said captivating insulator forming a conductive element subassembly, said connector comprising said conductive subassembly inserted in said central aperture of said rear insulator, said captivating insulator having an annular shoulder slightly larger than the central aperture of the rear insulator, said captivating insulator being formed of a resilient material enabling said annular shoulder to be compressed to a size to permit insertion of said captivating insulator in said rear insulator, said rear insulator having a counterbore to capture said annular shoulder as said conductive subassembly is inserted in said insulator means enabling axial assembly of said captivating insulator and conector element in said rear insulator while preventing axial movement of said conductive element subassembly with respect to said rear insulator.

2. The connector of claim 1, wherein said front insulator has a rear counterbore aligned with the counterbore of said rear insulator, said center contact having an annular shoulder bearing against the rear counterbore of said front insulator preventing forward movement of said center contact.

3. The connector of claim 2, wherein said outer conductive means comprises a front shell with a central aperture receiving said front insulator, and having an annular internal ridge inhibiting movement of said front insulator toward said other end of said outer conductive means, and a ferrule fit into said front shell and having an annular internal ridge abutting said rear insulator and inhibiting movement of said rear insulator towards said first end of said outer conductive means, said front and rear insulators abutting one another.

4. The connector of claim 3, wherein the end of said front shell towards said first end of said outer conductor means has a rolled end engaging a shaped outer surface of said ferrule to inhibit separation of said front shell and ferrule, thereby to fixedly hold said front and rear insulators.

5. The connector of claim 2, wherein said annular shoulder of said center contact is integrally formed with said center contact.

* * * * *